US006273369B1

(12) United States Patent
Nishimura et al.

(10) Patent No.: US 6,273,369 B1
(45) Date of Patent: Aug. 14, 2001

(54) KITE CONTROL AND QUICK RELEASE SYSTEM

(76) Inventors: Thomas G. Nishimura, deceased, late of Honolulu, HI (US); by Edwin T. Nishimura, legal representative, 3121 McEwan Rd. KPN, Lakebay, WA (US) 98349

( * ) Notice: Subject to any disclaimer, the term of this patent is extended or adjusted under 35 U.S.C. 154(b) by 0 days.

(21) Appl. No.: 09/545,999

(22) Filed: Apr. 10, 2000

Related U.S. Application Data

(60) Provisional application No. 60/135,444, filed on May 22, 1999.

(51) Int. Cl.[7] ..... A63H 27/08
(52) U.S. Cl. ..... 244/155 A; 244/153 R
(58) Field of Search ..... 244/155 A, 153 R

(56) References Cited

U.S. PATENT DOCUMENTS

| | | | | |
|---|---|---|---|---|
| 3,746,286 | * | 7/1973 | Christoffel | 244/155 A |
| 4,714,217 | | 12/1987 | Prentice | 244/155 R |
| 4,796,827 | | 1/1989 | Munt, III et al. | 242/96 |
| 4,884,765 | * | 12/1989 | Renecle | 244/155 A |
| 4,981,271 | | 1/1991 | Carter | 242/96 |
| 5,024,401 | | 6/1991 | Nakashima | 244/155 A |
| 5,026,007 | | 6/1991 | Gellert | 244/155 A |
| 5,054,718 | | 10/1991 | Hull et al. | 244/155 A |
| 5,064,150 | | 11/1991 | Prouty | 244/155 A |
| 5,127,612 | | 7/1992 | Onstott | 244/155 R |
| 5,180,123 | | 1/1993 | Lin | 244/155 A |
| 5,213,289 | * | 5/1993 | Barresi | 244/153 R |
| 5,366,182 | | 11/1994 | Roeseler et al. | 244/155 R |

* cited by examiner

*Primary Examiner*—J. Woodrow Eldred
(74) *Attorney, Agent, or Firm*—Seth M. Reiss

(57) ABSTRACT

An improved kite control and quick release system useful in kitesurfing and other kite related sports, comprising a hollow control bar capped at each end by symmetrical, elongated end fittings. The end fittings project kiteward, away from the sailor, with kite leads secured to the distal aspect of each end fitting. Each end fitting includes one or more concave winding surfaces to accommodate the winding and stowage of kite leads and lines. The system also includes an improved quick release means which, according to one preferred embodiment, comprises an aperture formed within one of the end fittings, a stop, and a release tether with handle. One of the two kite leads is passed through the aperture before being secured to the release tether. The stop, attached to the lead between the end fitting and the tether, secures the lead to the control bar while the kite is underway. The sailor can quickly release the force of the kite, de-powering the kite, by releasing the control bar while restraining the tethered release handle. The kite lead opposite the tethered lead flies free, rotating the control bar and kite and spilling wind from the kite. Once de-powered, the sailor can easily regain control of the bar and redeploy the kite with minimal effort.

14 Claims, 9 Drawing Sheets

KITE CONTROL AND QUICK RELEASE SYSTEM

RELATED PATENT APPLICATIONS

This non-provisional application is based on and claims the benefit of U.S. Provisional Application No. 60/135,444 filed May 22, 1999.

BACKGROUND OF INVENTION

1. Field of Invention

The present invention relates to traction kites generally. In particular, this invention describes an improved kite control bar having a quick release mechanism intended to facilitate kite related sports such as the new sport of kitesurfing.

2. Description of the Prior Art

In recent years, new designs of kites and related equipment have helped make feasible a new sport called, alternatively, kitesurfing, kiteboarding, or flysurfing. The sport, illustrated in FIG. 1, involves a sailor manipulating a large kite to power a surfboard style flotation device. The kites being used for this sport are capable of generating large forces making it desirable for the kite sailor to have a means to quickly de-power, or release, the kite under specific circumstances, for convenience and well as sailor safety.

Because the kites employ a plurality of long lines, the tasks of breaking down, stowage, and setting up the kites tend to be long and tedious. Methods for facilitating the winding and stowage of kite lines are therefore also desirable and sought after by kitesurfers.

There are available a number of known systems for controlling and de-powering kites and for stowage of kite lines. Two prior art systems best known and most widely used by kitesurfers are described in detail below. All such prior art control and quick release systems, and the functional aspects of the control bars used by kite sailors to control and de-power kites, have specific known limitations. Such limitations include, but are not limited to, long tether lines that can become entangled and/or cause injury, risk of hand injury due to proximity of hands to kite leads and lines, inadequate hardware for efficient kite lead and line stowage, quick release systems which are difficult to activate and/or perform in an unreliable manner, and quick release systems which require extensive time and effort to re-assemble prior to kite reIs5 deployment.

Presently available control bars, for example, connect directly to kite leads exposing the sailor's hands to risk of injury. These control bars also lack utilitarian winding surfaces that promote quick and reliable stowage of kite leads and kite lines, avoiding problematic tangling of lines between uses. Other available quick release systems, like those employing snap shackles, are unreliable, inefficient, and require the sailor to swim some distance after release to re-engage the kite lead with the control bar and resume sailing.

Moreover, prior art systems that attempt to address some of these limitations do so by combining a number of separate components, rendering the completed article complex and expensive to manufacture.

Accordingly, among the primary objects of the present invention are to provide an improved control bar and quick release system which minimizes the risk of line entanglement and sailor injury; enhances the sailor's ability to control the kite; facilitates quick release and de-powering of the kite as well as easy re-deployment of the kite after release; promotes the efficient winding and stowage of kite leads and lines; and is easy and inexpensive to manufacture relative to presently available kite control and quick release systems.

SUMMARY OF THE INVENTION

These and other objects are accomplished in the present invention, an improved control and quick release system to be employed with traction kites including kites used to power surfboarders, skiers, skateboarders and other mobile craft. According to a preferred embodiment, the improved control bar is comprised of a light weight hollow tube capped at each end by symmetrical, elongated end fittings. The end fittings project kiteward, away from the sailor and each includes ridges and a concave winding surface to accommodate wound and stored kite leads and lines. A kite lead is secured to the distal aspect of each kite fitting which leads are, in turn, secured to kite lines that connect to the kite.

Also according to the system of the present invention is an improved quick release means comprising an aperture formed within one of the end fittings or otherwise mounted at one end of the control bar, a stop, and a release tether with handle. One of the two kite leads is by passed through the aperture before being attached to the tether. The stop, secured to the lead and/or tether at a point between the aperture and release handle, serves to secure the lead to the control bar and prevents the tether from being pulled through the aperture while the kite is underway. The sailor can quickly release the force of the kite, i.e. de-power the kite, by releasing the control bar while restraining the tethered handle. The kite lead opposite the tethered lead flies free, rotating the control bar and allowing the bar to slide along the tethered lead towards the kite. The kite rotates, spills its wind, and drifts downward to the water surface. Once depowered, the sailor can easily regain control of the bar, and redeploy the kite, with minimal effort.

The present invention may be employed with kites having two or more lines and with variously shaped control bars, as for example, control bars configured to exhibit a handlebar shape. The end fittings may also be varied to provide alternatively configured concave winding surfaces having different advantages.

Further objects and advantages of this invention will become apparent from consideration of the drawings and ensuing description.

DETAILED DESCRIPTION OF THE PREFERRED EMBODIMENTS

Figure 1:
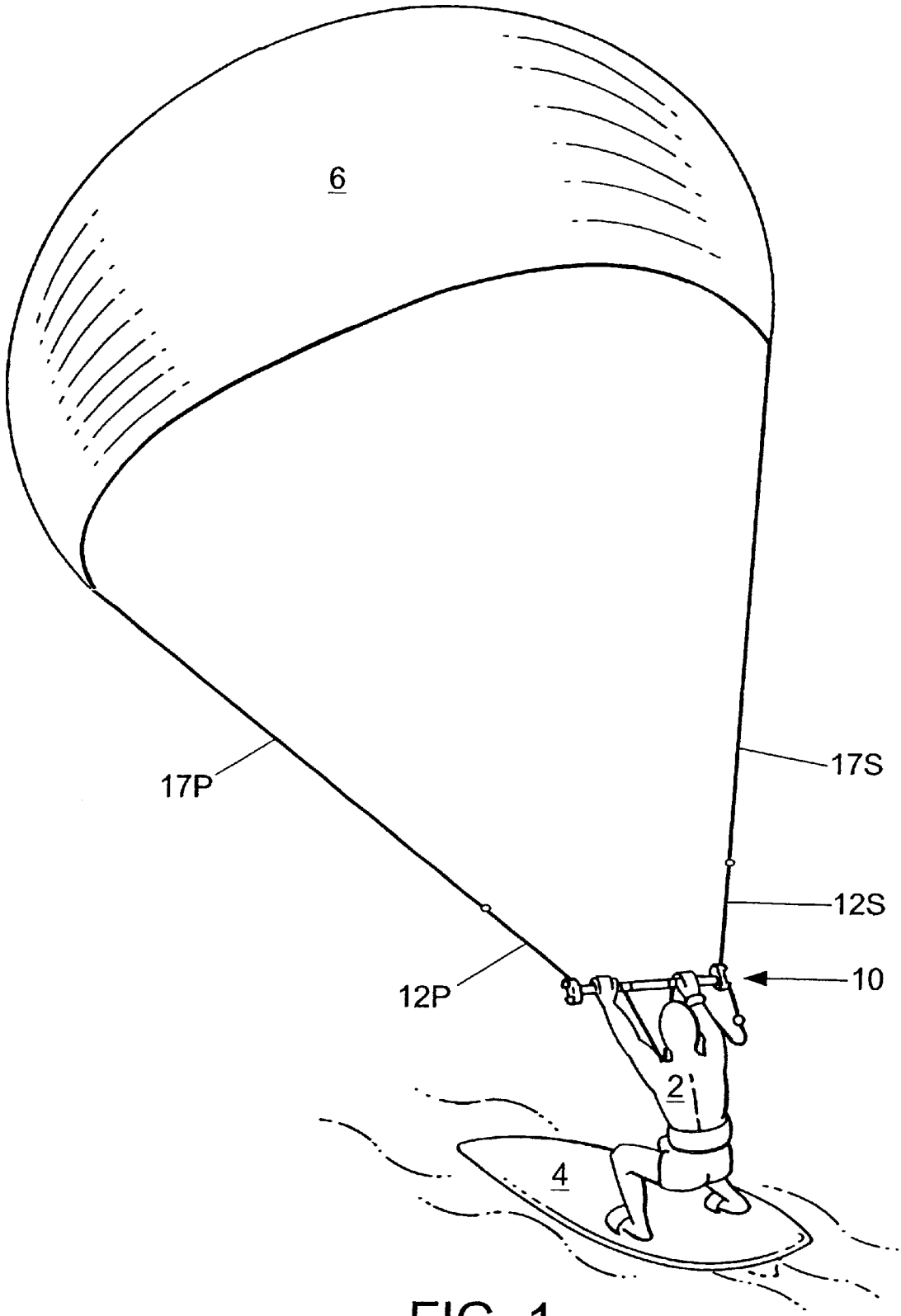
FIG. 1 is a perspective view of a kitesurfer riding a surfboard powered by a kite controlled using my improved control and quick release system 10.

The new sport of kitesurfing, showing the role played by control and quick release systems, is illustrated in FIG. 1. A sailor 2 is riding a kiteboard 4 powered by a kite 6. Sailor 2 controls kite 6 using a control and quick release system 10. Port and starboard kite leads 12P and 12S, and port and starboard kite lines 17P and 17S, connect control and quick release system 10 to kite 6. The control and quick release system 10 depicted in FIG. 1 is my improved system, the details of which are described below with reference to FIGS. 1 and 4–9.

1. Prior Art Control and Release Systems

The novel and utilitarian aspects of my improved control and quick release system are best appreciated and understood when comparing the details of my system to the previously available, prior art control and release systems.

Figure 2:
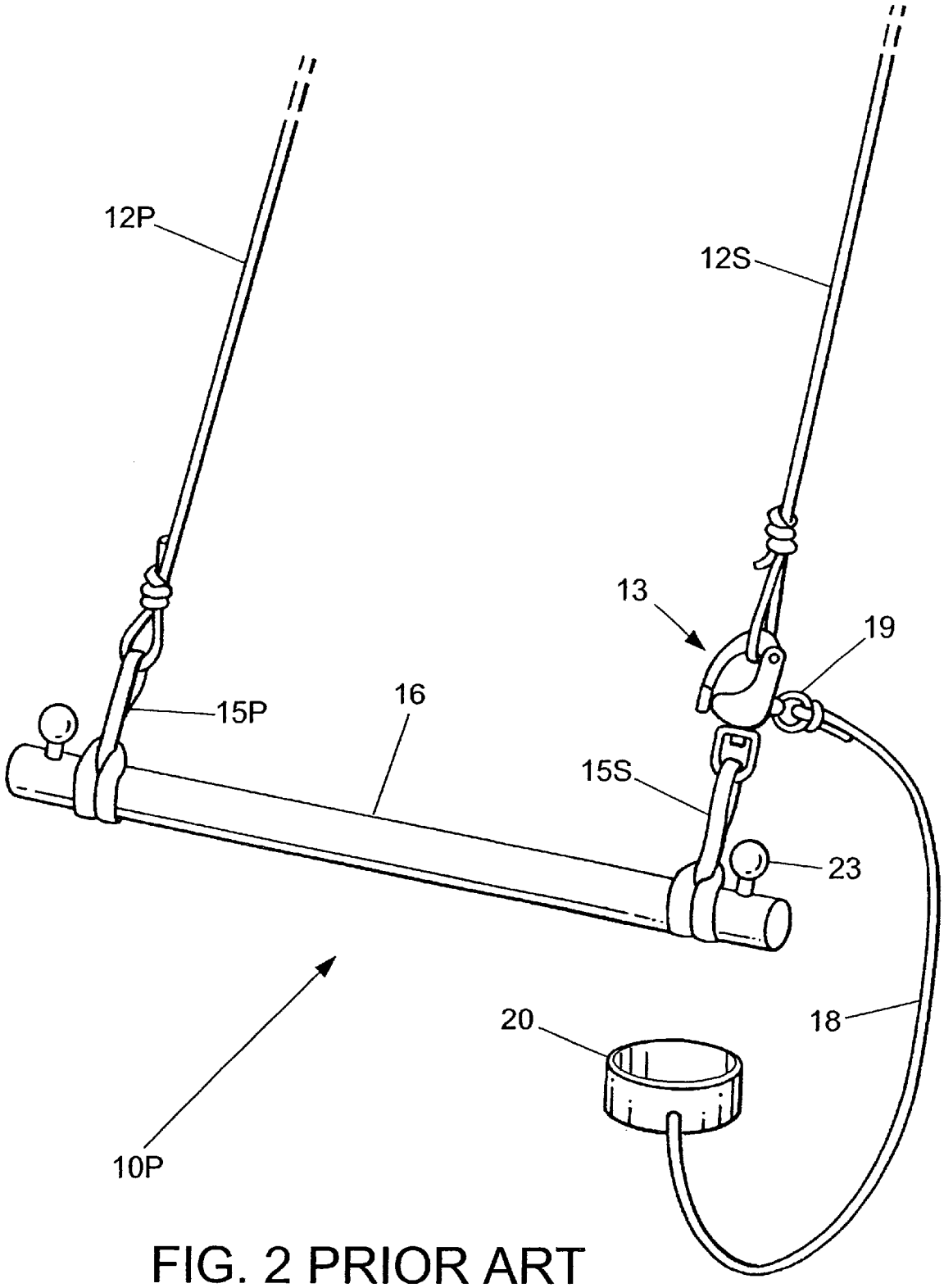
FIG. 2 PRIOR ART
FIG. 2 is a perspective view of a prior art kite control and quick release system 10P.

One such prior art control and quick release system, 10P, is depicted in FIG. 2. Prior art system 10P is comprised of a control bar 16, two identical kite leads 12P and 12S, two identical straps 15P and 15S, two identical winding cleats 23, a snap shackle 13, a release tether 18 and a wristband 20. One each end of straps 15P and 15S are secured to the port and starboard ends, respectively, of bar 16. Snap shackle 13 is secured to the opposite end of one of the straps (according to the prior art embodiment depicted in FIG. 2, snap shackle 13 is secured to strap 15S). Kite lead 12P is secured to bar 16 through strap 15P, while kite lead 12S is secured to bar 16 through snap shackle 13 and strap 15S. The opposite (distal) ends of kite leads 12S and 12P are secured to two kite lines, 17S and 17P, that connect the control and release system to kite 6 (as shown in FIG. 1). One end of release tether 18 is tied to a release pin 19 inserted within snap shackle 13. Attached to the other end of tether 18 is wristband 20, designed to wrap around the sailor's wrist and secure tether 18 to the sailor.

To de-power a kite using the prior art apparatus shown in FIG. 1, the sailor releases control bar 16 with both hands. As the kite, under the force of wind, continues to pull away from the sailor, tether 18 is pulled taught and pulls on release pin 19. With pin 19 withdrawn, shackle 13 can open, releasing kite lead 12S previously secured to the snap shackle 13. The kite, restrained now only by lead 12P, opens, spills its wind, and drifts downward to the water surface.

Among the limitations inherent to the above described prior art system 10P is that, following release, the sailor must retrieve and reconnect snap shackle 13 using pin 19 to released kite lead 12S before the kite can be flown again. This can be difficult for the sailor to do while swimming in water and, in any case, consumes time and effort. A second limitation is that commercially available snap shackles 13, not being designed for use in kitesurfing control and release systems, demonstrate a geometry not conducive to the reliable and reproducible release of lead 12S when employed as depicted in FIG. 2. It is not uncommon that control and release systems which employ hardware such as snap shackles 13 fail to release on a first attempt, or after several, particularly under high wind, high load conditions. An incomplete release can result in bar 16 being dragged a substantial distance in the water, resulting in tangled lines. In addition, quality snap shackles 13 are not inexpensive and increase the cost of the final system.

Figure 3:
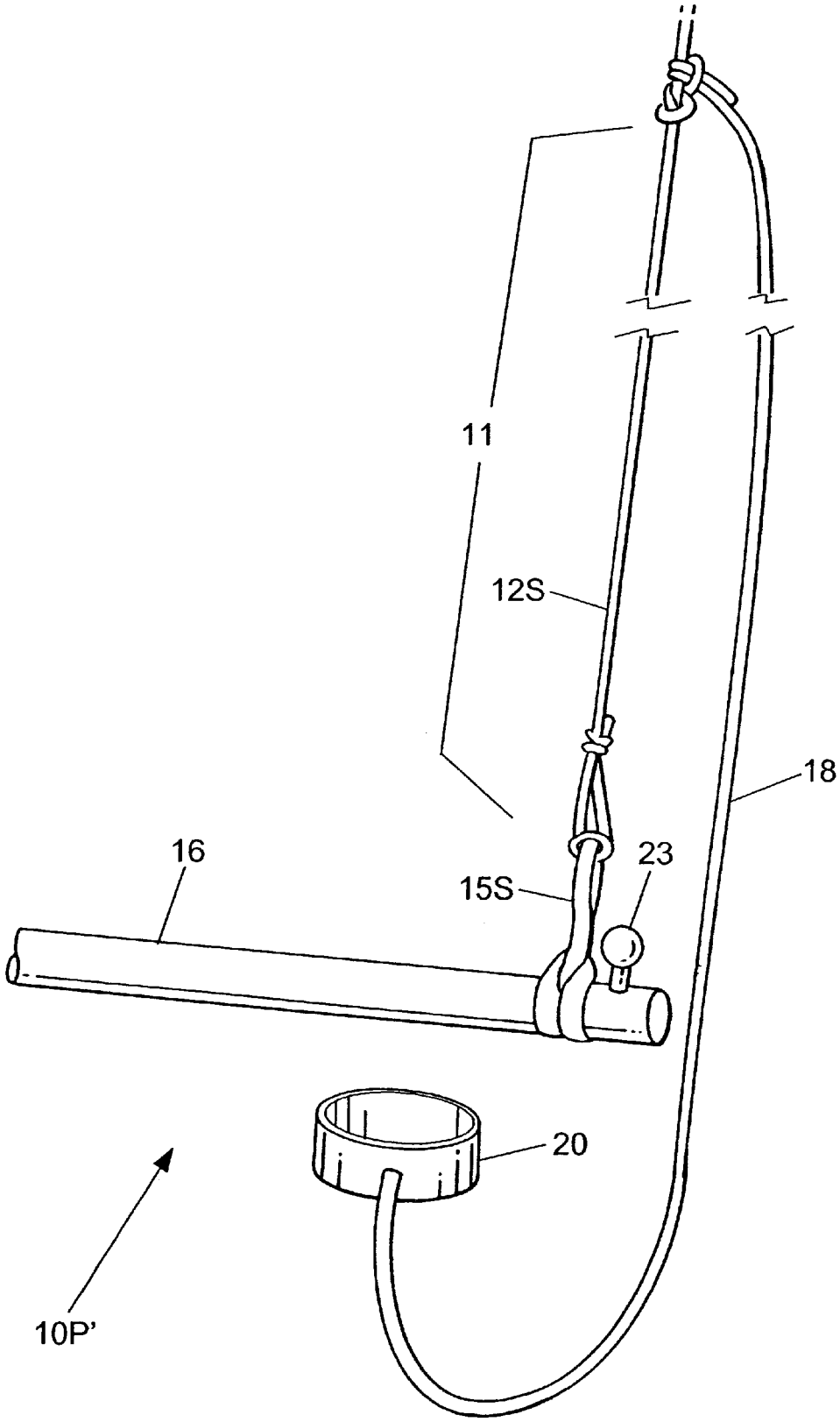
FIG. 3 PRIOR ART
FIG. 3 is a close-up perspective view of the starboard portion of an alternative prior art control and quick release system 10P'.

The starboard portion of another embodiment 10P' of a commonly encountered prior art control and quick release system used by kitesurfers is depicted in FIG. 3. According to prior art system 10P', starboard kite lead 12S is tied directly to strap 15S. Release tether 18 is tied to kite lead 12S at a distance 11 above strap 15S. Distance 11 measures at least half the span of the kite. Typical kite spans can be 15 to 22 feet or more, so distance 11, along lead 12S between strap 15S and tether 18, would be on the order of 7.5 to 11 feet or more. To de-power the kite using the quick release system 10P' depicted in FIG. 2, the sailor lets go of control bar 16, leaving only tether 18 to restrain the kite. The kite pulls away from the sailor causing control bar 16 to rotate relative to the kite, opening the kite and releasing wind.

A significant limitations of prior art control and quick release system 10P' depicted in FIG. 2 is that release tether 18 needs to be relatively long, resulting in additional line that can become entangled with the sailor, surfboard or control bar 16. The long tether 18 also causes additional aerodynamic drag and adds to the complexity of handling kite lines during times such as set-up and breakdown. Use of a shorter tether 18 according to this prior art embodiment will result in incomplete, or ineffective de-powering, causing the kite to drag the control bar and sailor a substantial distance and the kite lines to become entangled.

Also depicted in FIGS. 2 and 3, but not yet discussed, are winding cleats 23. Cleats 23 are commonly found on prior art systems, mounted one on each side of control bars 16. Cleats 23 facilitate kite set-up and breakdown by providing a means for winding and storing leads 12 and lines 17 (shown in FIG. 1). Kite leads 12P and 12S are wound onto cleats 23 to make storage of the lines easy and to avoid tangles during breakdown, stowage and set-up. However commercially available cleats 23, which can be purchased from marine or hardware stores, do not promote easy and rapid winding of kite leads and lines due to their positioning and the narrow width of their winding gap. Winding cleats 23 also represent further expense, in terms of materials and manufacturing, to the completed cost of prior art control and release systems 10P and 10P'.

Prior art control bars 16 are typically made from lightweight hollow tubing, as for example aluminum tubing. The ends of bars 16 are relatively sharp. Some commercially available control bars 16 do not have end caps to serve as protection against damage to the kite board or injury to the sailor. While it is a simple matter to place end caps on the control bars, these caps constitute an additional component and expense in the manufacture of control and quick release systems.

Another limitation inherent in prior art quick release systems such as those depicted in FIGS. 2 and 3 is that kite lead lines 12P and 12S attach either directly to control bar 16, or attached to control bar 16 through webbing straps. The webbing straps are intended to provide some degree of protection against injury to the sailor's hands or fingers as, for example, when the sailor loses his or her grip on control bar 16 with one hand. A partially lost grip often causes control bar 16 to angle away from the sailor, causing the kite to go into a spin. This, in turn, generates a force large enough to cause kite leads 12S or 12P to crimp severely against, and damage, the sailor's hand. Even with the use of such webbing, which tends to lie flat against the hand or fingers following each mishap, the sailor might not be able to maintain his grip on control bar 16, and the pressure of the webbing against the sailor's hand can still cause injury, particularly upon letting go of the control bar.

As will be seen, my novel kite control and quick release system overcomes the limitations inherent to the prior art systems described with reference to FIGS. 2 and 3, and provides other advantages as well.

2. My Improved Kite Control and Quick Release System

Figure 4:
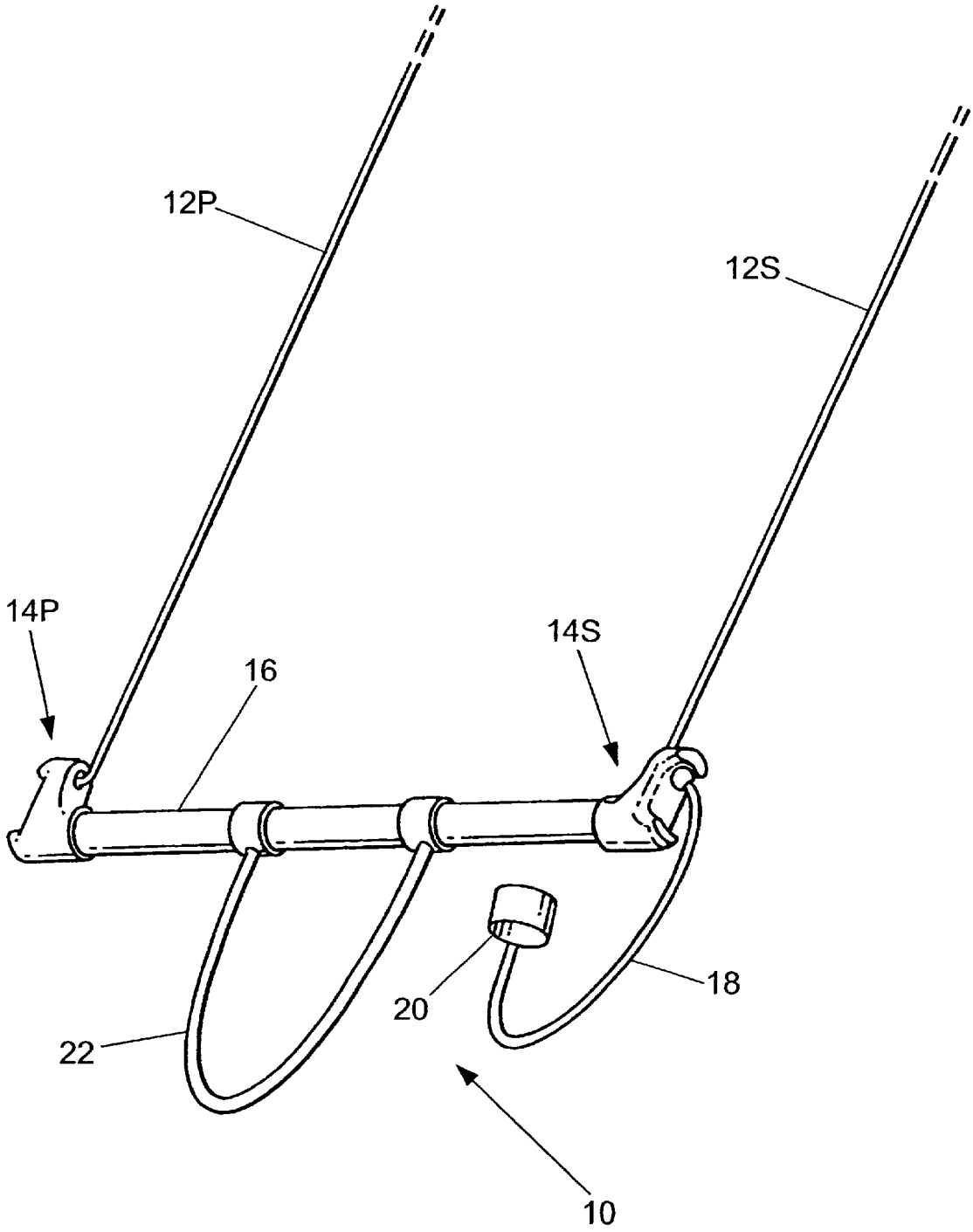
FIG. 4 is a perspective view of my novel control and quick release system 10.

FIG. 4 illustrates in perspective view the main components of a preferred embodiment of my improved kite control and quick release system 10, being control bar 16, two elongated end fittings 14, kite leads 12, release tether 18, wristband 20, and a harness line 22.

Control bar 16 is best constructed from a lightweight material such as aluminum or composite hollow tubing. The port end fitting 14P is secured to the port end of bar 16, and the starboard end fitting 14S is secured to the starboard end of bar 16. One end each of kite lead lines 12P and 12S are secured to the distal aspects of end fittings 14P and 14S, respectively. Lead lines 12P and 12S extend out some distance from control bar 16 at which point each connects to a kite line 17 which connects, in turn, to kite 6 as shown in FIG. 1.

Also attached to the end of starboard lead line 12S depicted in FIG. 4 is release tether 18 (the details of which are shown and described with reference to FIG. 6). Connected to the opposite end of tether 18 is a wristband 20. Hamess line 22, the use of which is well known to windsurfers as well as kitesurfers for engaging a harness vest worn by the sailor, is attached centrally about bar 16.

Figure 5:
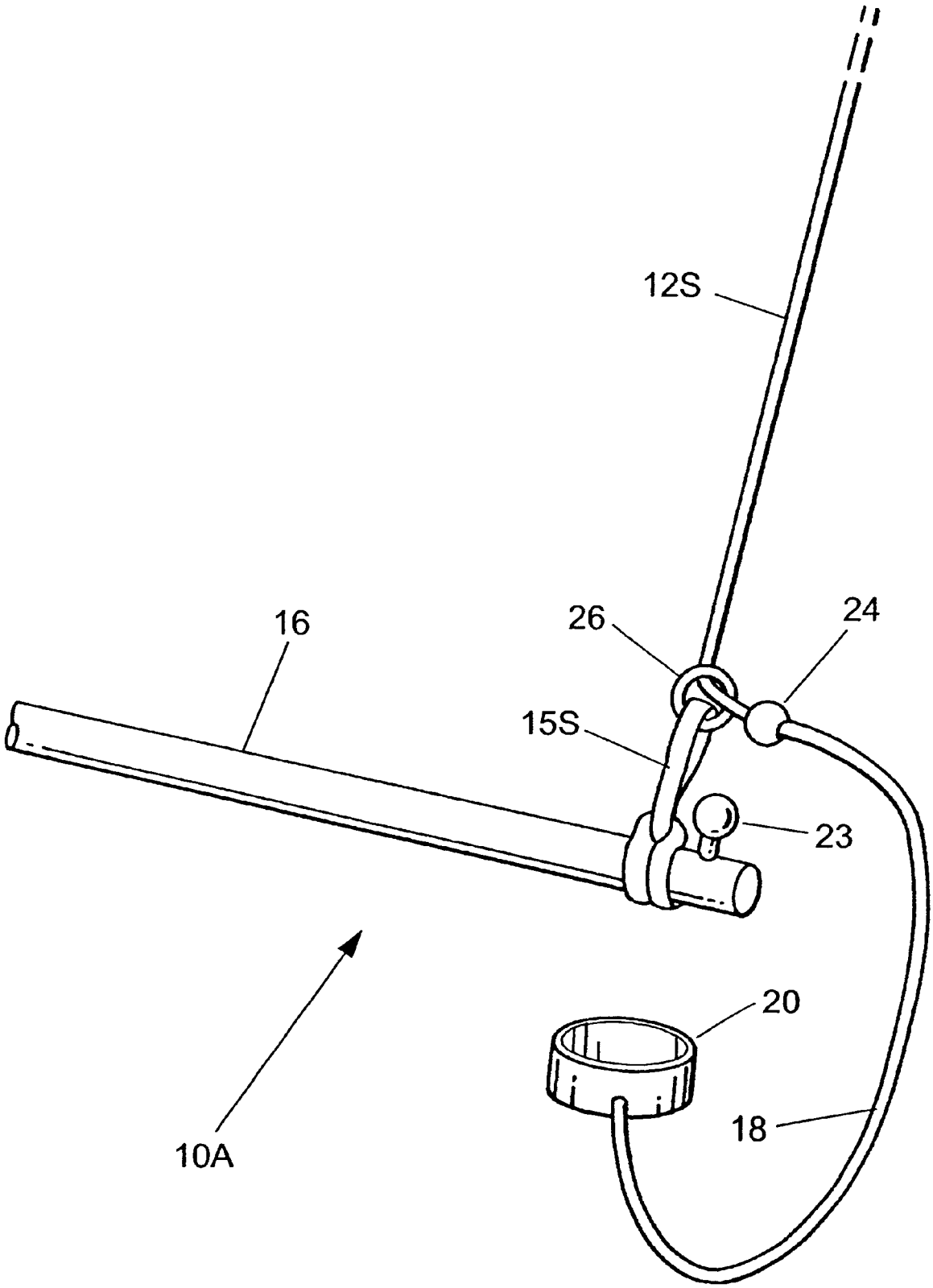
FIG. 5 is a close-up perspective view of the starboard portion of a first preferred embodiment 10A of my control and quick release system.

FIG. 5 is a partial view of the starboard aspect of a first preferred embodiment 10A of my invention, illustrating details of the quick release feature of my system. According to this embodiment, prior art strap 15S is attached to the starboard aspect of bar 16. A lead ring 26, which can be a stainless steel ring, is secured to the opposite (distal) end of strap 15S. Kite lead 12S is connected, according to this embodiment, so as to be continuous with tether 18. Lead 12S/tether 18 is threaded through lead ring 26 and attached to wristband 20. A stop 24 is secured at a specific point along the length lead 12S/tether 18 between ring 26 and wristband 20 using means such as a knot. A prior art style cleat 23 is mounted along bar 16 near its end.

It will be noted that, while the preferred embodiment depicted in FIG. 5 employs prior art strap 15S, prior art cleat 23 and no end fittings 14, the manner in which strap 15S attaches to lead 12S, and the quick release operation of this improved system discussed in detail below, are novel and distinct from those of the prior art systems depicted in FIGS. 2 and 3 and described above.

Figure 6:
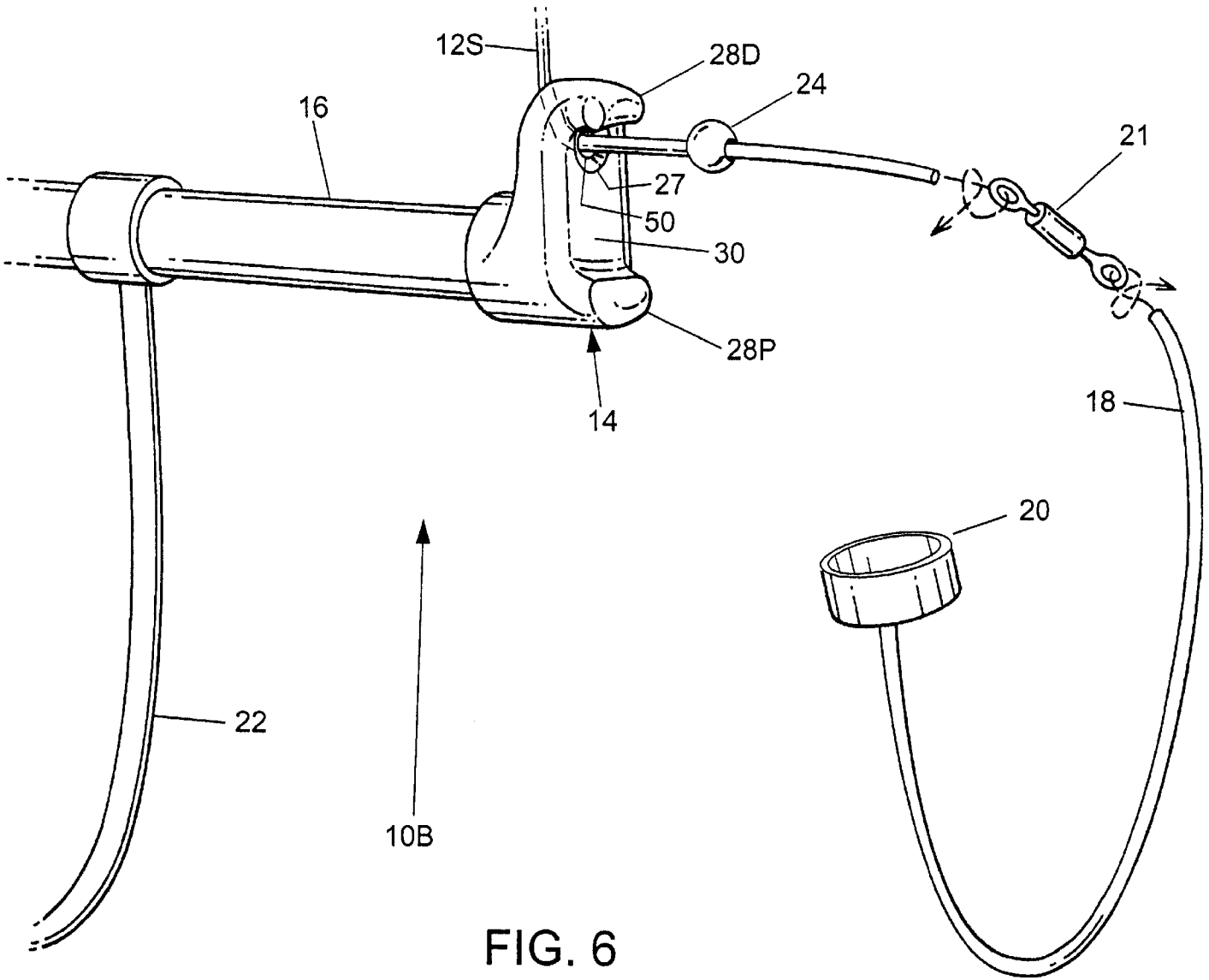
FIG. 6 is a close-up perspective exploded view of the starboard portion of a second preferred embodiment 10B of my control and quick release system.

FIG. 6 shows, in exploded view, details of the starboard portion of a second preferred embodiment 10B of my improved kite control and quick release system. End fitting 14S is attached to and serves to cap the starboard end of control bar 16. End fitting 14S is elongated in a direction perpendicular to the axis of control bar 16 and such that, when bar 16 is held and the kite is underway, end fitting 14S projects kiteward. End fitting 14S includes a distal lip 28D, a proximal lip 28P, and a winding surface 30. Surface 30 spans the distance between lips 28D and 28P. An aperture 50 is formed through the distal aspect of winding surface 30, just below lip 28D. Lips 28D and 28P each project outward from control bar 16, parallel to the axis of bar 16. Together winding surface 30 and lips 28D and 28P form a concave winding surface that faces outwards away from the center of control bar 16. This winding surface, together with the winding surface provided by the mirror image port end fitting 14P (shown in FIG. 4), accommodate winding and stowage of kite leads 12 and kite lines 17.

Lead line 12S extending from kite line 17S and kite 6 (as shown in FIG. 1) is passed through aperture 50, entering from the inward facing side of fitting 14S and exiting the opposite side of fitting 14S. Lead line 12S then continues through stop 24 and terminates in a knot 25 which secures the proximal end of lead 12S to tether 18, in this case through a swivel connector 21. Wristband 20 is secured to the opposite end of tether 18.

Stop 24, shown in FIG. 6, and also in the first preferred embodiment illustrated in FIG. 5, can be of molded plastic or comprised of a stainless steel washer or other hardware accessory. The outside diameter of stop 24 is slightly larger than aperture 50, and can be spherical or other shape having a smooth outside surface to avoid unintentional engagement with other system components. As illustrated in FIG. 6, knot 25, which secures lead 12S to tether 18, acts also together with stop 24 to secure lead 12S to bar 16 and prevent tether 18 from passing through aperture 50 when the kite is underway. Similarly in the first preferred embodiment of my invention shown in FIG. 5, a knot (not shown) secures stop 24 to a specific point along continuous lead 12S/tether 18 in order to secure control bar 16 to lead 12S and prevent stop 24 from traveling down tether 18 to wristband 20 during sailing activities.

A beveled edge 27 is formed on surface 30 around the outward facing side of aperture 50 (and also around the inward facing side as illustrated and discussed with reference to FIG. 7 below). Beveled edge 27 facilitates passage through aperture 50 of lead 12S and, when desirable, of the knot that secures lead line 12S to kite line 17S (shown in FIG. 1) during the release mode. This is not to be confused with knot 25 discussed above which engages stop 24 and is designed specifically not to pass through aperture 50.

Tether 18 is of a predetermined length. In the context of the first preferred embodiment 10A shown in FIG. 5, the length of tether 18 is determined by the point at which stop 24 is fixed along the length of the continuous lead 12S/tether 18. A short tether 18 will limit the distance the sailor will have to move his or her arm relative to control bar 16, but minimizes the issue of unintended entanglement A longer tether 18 allows the sailor more freedom of arm movement while increasing the risk of entanglement. Swivel connector 21, which is optional, assist to prevent tether 18 from becoming twisted and prone to entanglement.

Figure 7:
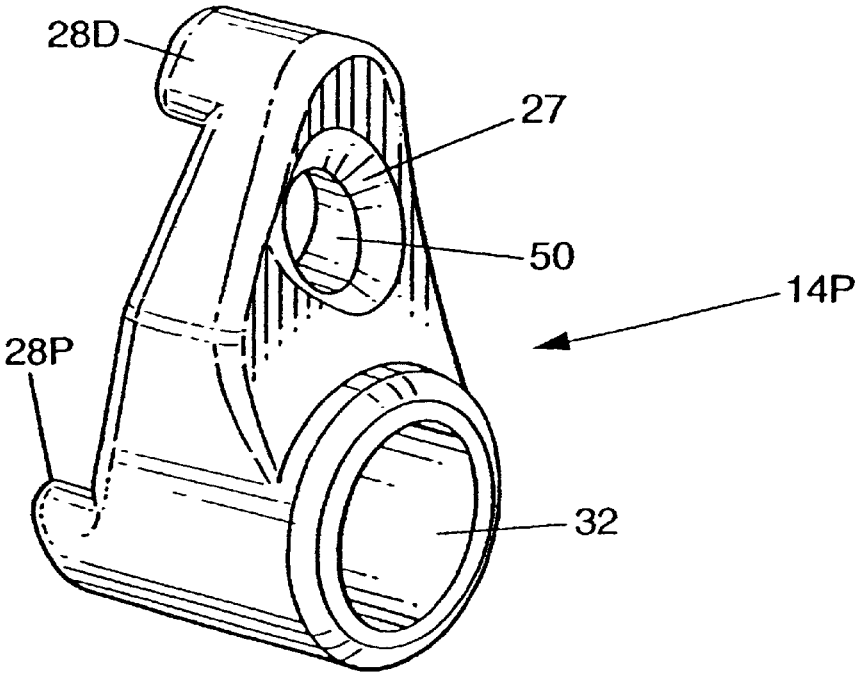
FIG. 7 is a close-up perspective view of a first preferred embodiment 14P of an end fitting used in my improved control and quick release systems 10.

FIG. 7 illustrates the detail of elongated end fitting 14P (which is identical with end fitting 14S shown in FIG. 6) as employed in my control and quick release systems 10B. End fitting 14P is typically molded out of a strong plastic such as nylon or plastic-fiber composite. A bore 32 extends partially into the inside base of end fitting 14P to receive, house and cap the end of control bar 16. The end of control bar 16 is secured within bore 32 by glue and/or a bolt. End fittings 14P and 14S, when properly secured to bar 16 as depicted in FIG. 4, will effectively keep water out of hollow bar 16 and allow system 10 to float on top of the water. End fittings 14P and 14S also serve as smooth protective end caps to cover the sharp ends of control bar 16 preventing, thereby, damage and injury to a kite board or user which exposed edges could cause.

Aperture 50 is formed through the distal aspect of end fitting 14P. The axis of aperture 50 is generally parallel to the bar 16. While other orientations of aperture 50 are possible, the orientation depicted and described minimizes resistance of the lead line 12P when passing through aperture 50 during release mode. Aperture 50 is of sufficient diameter as to allow the lead line 12P to easily slide through. If utilizing lead lines of 5/32 inch diameter, an aperture 50 of approximately 0.5" diameter or greater is recommended if, during release mode, it is desired that knots used to secure lead lines 12 to kite lines 17 pass through aperture 50. Beveled edge 27, shown here on the inward facing side of aperture 50 (with the opposing outward facing beveled edge 27 being shown in FIG. 6), allows easier passage of lead line 12P as knotted to kite line 17P to slide into and through aperture 50. Again, this is not to be confused with knot 25 in FIG. 6 which is designed not to pass through either stop 24 or aperture 50.

Figure 7A:
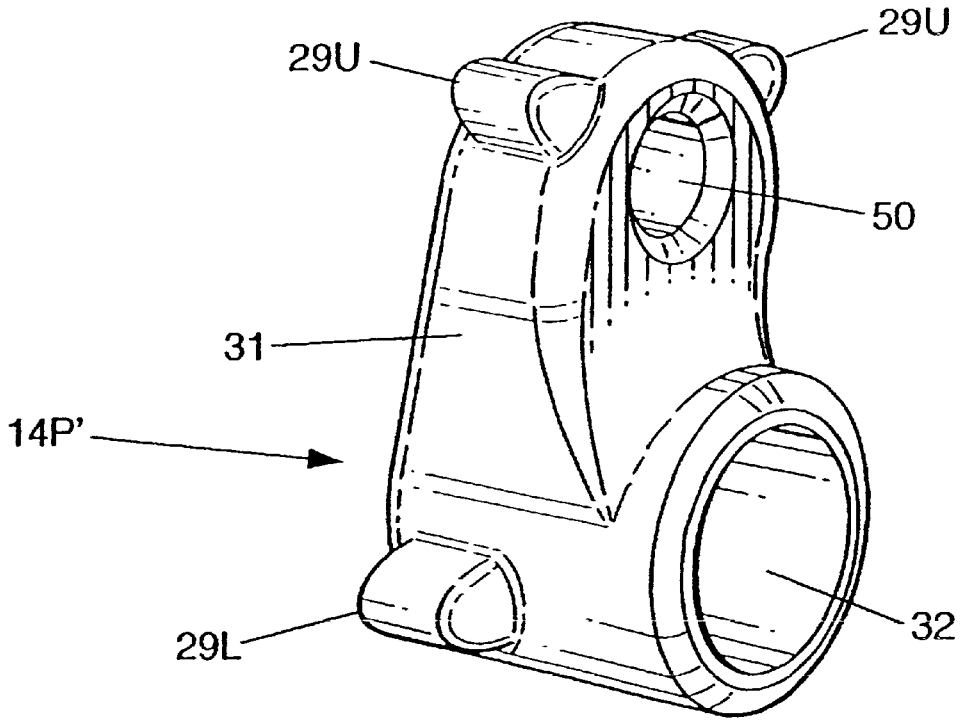
FIG. 7A is a close-up perspective view of second preferred embodiment 14P' of an end fitting used in my improved control and quick release systems 10.

Details of an alternative preferred embodiment 14P' of end fitting 14P is depicted in FIG. 7A. End fitting 14' is very similar to end fitting 14 with the following differences. Rather than lips 28D and 28P extending outward away from the center control bar 16, two upper ridges 29U and two lower ridges 29L (only one of which can be seen in FIG. 7A) extend from the top and bottom, respectively, of elongated end fitting 14', forming thereby two concave winding surfaces 31 (only one of which can be seen in FIG. 7A) laterally along the sides of end fitting 14'.

Figure 8:
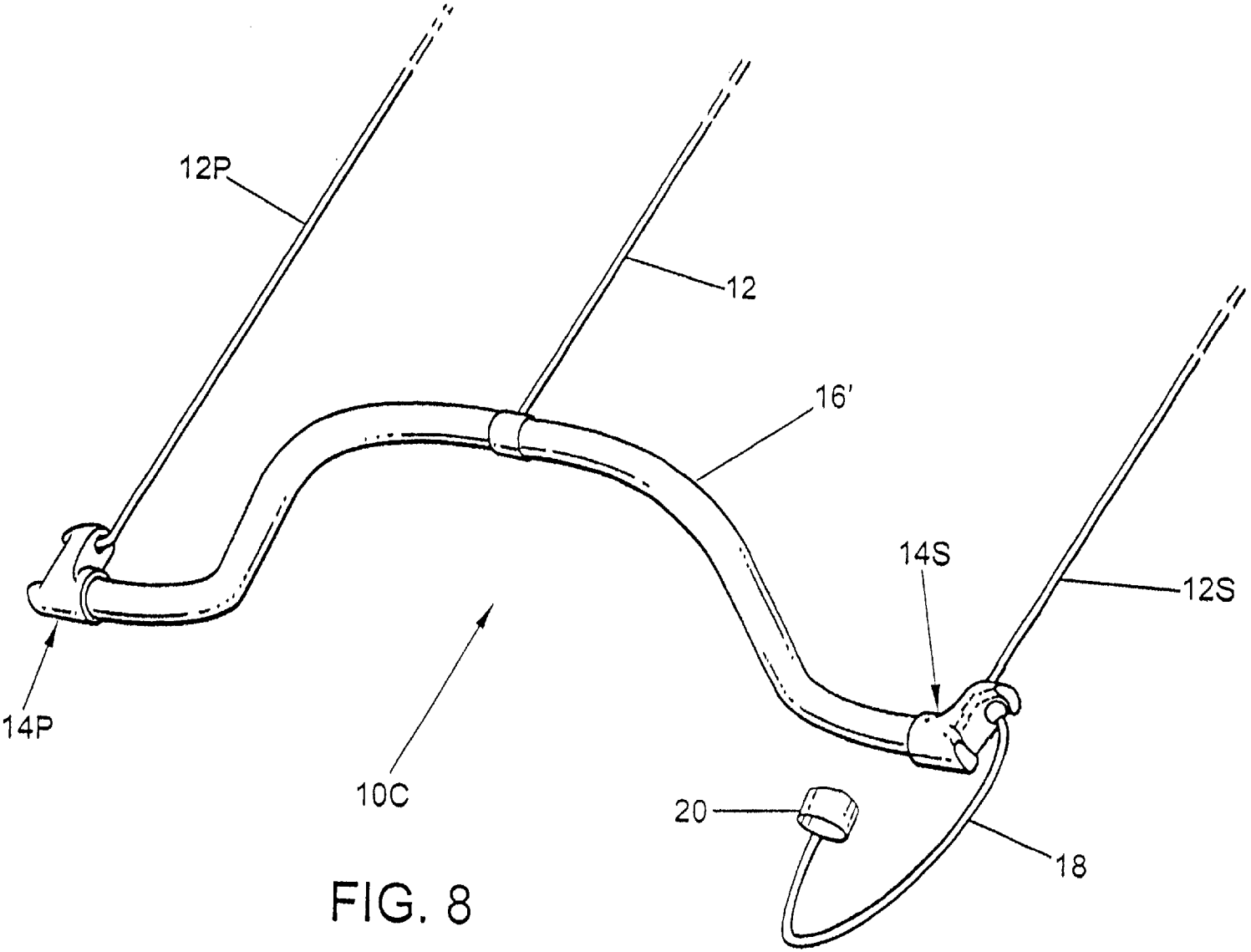
FIG. 8 shows a perspective view of a third preferred embodiment 10C of my control and quick release system.

FIG. 8 illustrates a third preferred embodiment 10C of my control and quick release system, this time employed with a kite having more than two lead lines. A reconfigured control bar 16', exhibiting a handlebar shape, is well known in the art. Kite leads 12S and 12P are secured to end fittings 14S and 14P respectively. A third kite lead 12M is secured to the center of bar 16'. Kite lead 12M at its far (distal) end will connect to either one or two kite lines 17 depending upon whether the kite being flown is designed for three or four lines. Kite lead 12S is secured to bar 16 through aperture 50 in end fitting 14S just as in the second preferred embodiment 10B illustrated in FIG. 6. Harness lines are not shown but can be employed.

3. Operation of My Improved Control and Quick Release System

The use of my improved control and quick release system is described with reference to FIGS. 1, and 4 through 9. Under normal conditions, the sailor grasps control bar 16 with right and left hands placed near the starboard and port ends, respectively, of bar 16. Wristband 20 may be placed around the sailor's wrist closest to the lead line to which tether 18 is attached.

Alternatively, tether 18 can be very short and a small, easily gripped object in the manner of a release handle 20' (illustrated in FIG. 9), which the sailor grasps in order to activate the quick release, can be substituted for wristband 20. Utilizing a release handle 20' in lieu of wristband 20 frees the sailor to remove either hand completely from the control bar and perform maneuvers such as behind the back passing of control bar 16, without the obvious limitations consequent to wearing a wristband. If the sailor wishes to de-power the kite, as in case of an emergency, or in order to land the kite, the sailor simply grasps release handle 20' with one hand and then releases control bar 16 from both hands.

The function of winding surface 30 and lips 28D and 28P is discussed with reference to FIG. 6. The lead lines 12P and 12S and kite lines 17P and 17S may be stored by winding these leads and lines, from end to end, around and onto winding surfaces 30. This winding is practiced when the kite is not being flown, for easy keeping of the lines. Winding surface 30 may typically extend approximately 1 or 2 inches in height for faster and easier winding of lines, since a wider winding surface perpendicular to the direction of winding facilitates easy winding. The depth of lips 28D and 28P also determine the amount of line that can be wound onto winding surface 30. The tips of lips 28 are rounded for safety.

FIG. 7A is referred to in describing the function of winding surface 31 and ridges 29U and 29L. The lead lines 12P and 12S and kite lines 17P and 17S may be stored by winding the leads and lines, from end to end, around and onto winding surfaces 31. The effect of having ridges 29U and 29L located on the front and back sides of fittings 14' is that lead lines 12 and kite lines 17 will begin to catch onto ridges 29U and 29L before the sailor begins to pass his hand around and outward of end fittings 14'. This is in contrast to the manner of using end fittings 14 shown in FIG. 7 in regard to which, when winding, the leads and lines do not encounter winding surface 30 until the sailor's hand has passed beyond the end of fittings 14. Winding leads and lines about end fittings 14' illustrated in FIG. 7A is therefore easier, and quicker, than winding leads and lines about end fittings 14 illustrated in FIG. 7. The winding surfaces of both end fittings , however, provide a greatly superior method for winding and stowage of lines when compared with the prior art cleats 23 illustrated in FIGS. 2 and 3.

Figure 9:
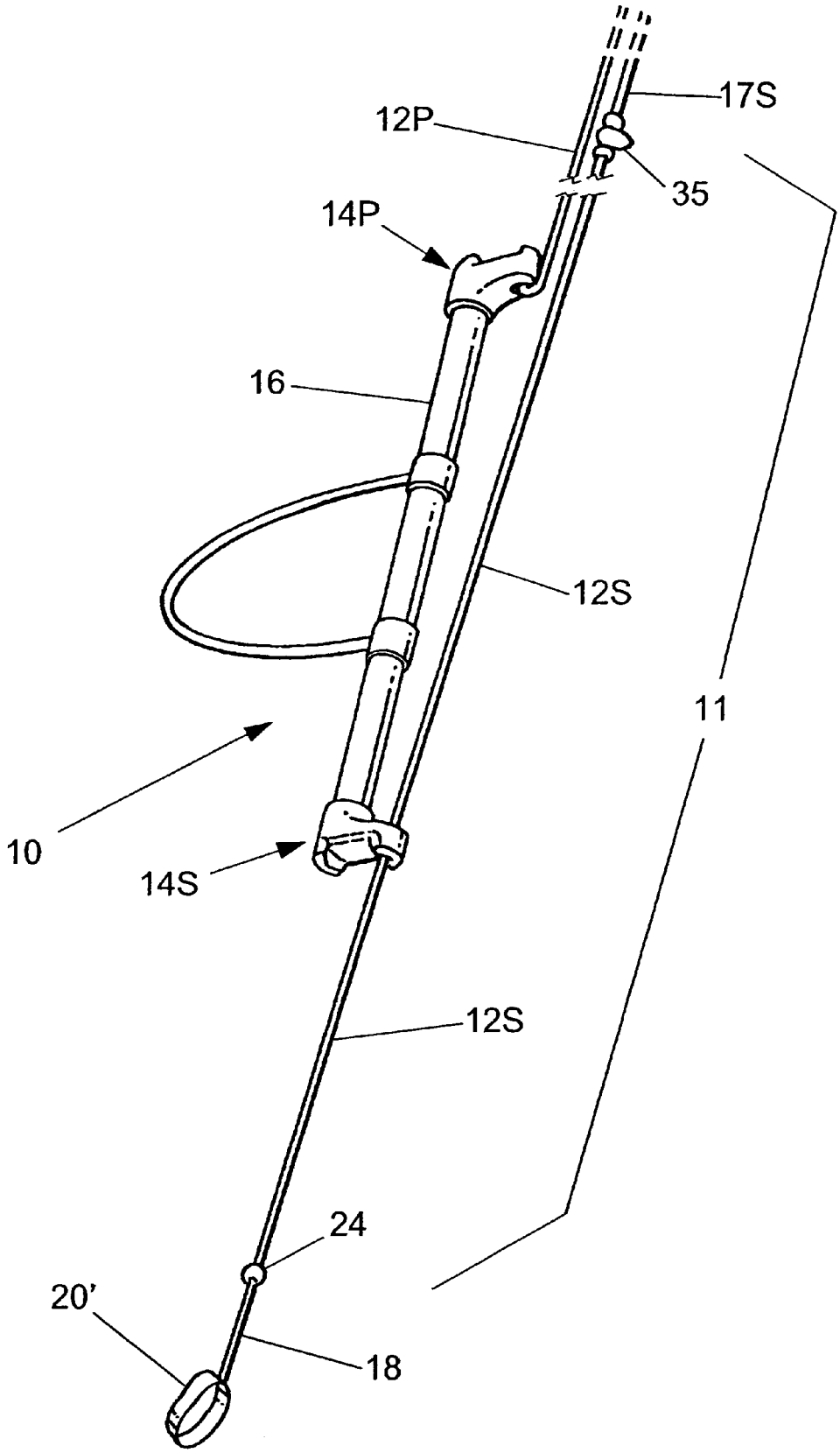
FIG. 9 shows a perspective view of my improved control and quick release system in the release mode.

FIG. 9 illustrates my improved control and quick release system 10 in a released mode. As depicted, control bar 16 has been completely released by the sailor who now only holds release handle 20'. The kite, still underway, pulls lead line 12P relative to lead line 12S, being restrained by the sailor. The starboard end of bar 16 being held, the port end of bar 16 rotates away from the sailor kiteward. Control bar 16 assumes an orientation parallel to lead line 12S as the kite continues to pull lead line 12P. End fitting 14S slides along lead line 12S towards kite 6. The orientation of aperture 50, with its axis parallel to control bar 16, minimizes the resistance of the lead line 12S sliding through end fitting 14S. Control bar 16 will continue to slide away from the sailor along lead line 12S until the kite has opened up completely spanwise and de-powered.

It should be noted that, according to the preferred embodiment depicted in FIG. 9, quick release system 10 is equipped with a removable release stop 35 secured at a point along lead 12S kiteward of end fitting 14S. Release stop 35 serves to stop bar 16 from sliding too far kiteward during the release maneuver, facilitating, thereby, quick recovery and re-deployment of the kite after release.

Release stop 35 can be secured to lead 12S by means of knots made on either side of stop 35, or by other means. In order to assure full release and de-powering of the kite, the distance 11 between stop 24 and release stop 35 must be at least half the span of the kite. This is analogous to the distance 11 discussed with reference to the prior art system 10P' illustrated in FIG. 3. Unlike the prior art system 10P' however, because distance 11 here is not comprised substantially of tether 18, but rather of lead 12, there is no necessity of employing a long tether 18 that risks annoying entanglement and drag.

Alternatively, release stop 35 can be mounted along line 17S, above leads 12S, for example when employing shorter leads 12 or where the sailor prefers to allow bar 16 to slide farther kiteward in order to ensure a quick and complete de-powering of the kite. In these cases, the orientation and bore of aperture 50 with bevel 27 serves to facilitate passage of the knots securing lead 12S to line 17S through end fitting 14S. However, because leads 12 are typically thicker and more durable than lines 17, leads 12 are more tolerant of being knotted making it preferable, in most cases, to secure stop 35 to lead 12.

Once the kite is de-powered, the sailor can swim the short distance to control bar 16 and, when ready, re-launch the kite. The sailor again grasps control bar 16 and swims away from the kite causing lead line 12P to become taut and actuate the kite. Lead line 12S slides through aperture 50 until stop 24 is encountered. The kite is now ready for re-launching. A number of commercially available kites designed to be re-launched from the water, such as the Wipika brand kite, can be quickly re-deployed in this manner using my improved system.

The control and quick release system discussed above will function equally on kite control bars designed for 3 and 4 line kites as shown in FIG. 8. The sailor activates the quick release in the same manner as for 2 line kites, by letting go of the control bar while restraining the system through wristband 20 or release handle 20'. Kite control bar 16' and the two unrestrained kite leads will travel away from the sailor, causing the kite to open up and de-power.

Although stop 24 prevents the lead line 12S from sliding completely inward and through aperture 50, stop 24 can also function to substitute for, or supplement, distal lip 28D. If as a substitute for lip 28D, only lip 28P is necessary, since the stop 24 and lip 28P are spaced apart and can form a concave surface similar to that formed by lips 28D, 28P and surface 30 in FIG. 6 onto which the kite lines can be wound.

Further, although the quick release feature of my system 10 has been illustrated as activated using the sailor's right hand, through the starboard aspect of the system, it will be appreciated that the quick release feature can equally be employed on the port side of bar 16 through the port lead 12P, as for example for the left-handed sailor; or configured at both ends of bar 16 through both leads 12S and 12P, in order to provide the sailor either release option. Because bar 16 and elongated end fittings 14 are symmetrical, configuring system 10 with a left-handed quick release is simply a matter of rotating system 10 as depicted in FIGS. 4–6 one hundred eighty degrees.

SUMMARY AND SCOPE

Accordingly, it will be readily appreciated that the improved kite control and quick release system of the present invention provides a safer, less expensive, more reliable, and easier to use system for controlling and de-powering kites used to propel water or other vehicles and for handling and stowage of kites leads and lines used with respect to such kites.

It will be appreciated, for example, that leads 12 are attached to the distal aspect of end fitting 14, spaced apart from bar 16, in order to provide the sailor increased kite control.

Spacing kite leads 12 away from bar 16 also serves to minimize the risk of injury to the kite sailor's hands from the binding of lead lines during extreme situations where control bar 16 is held by one hand only and the other end of control bar 16 is completely extended.

It is a further advantage of my control and quick release system that it eliminates the need for long release tether lines, such as those described with respect to the prior art system depicted in FIG. 3, which can be problematic to the sailor and which increase aerodynamic drag. My improved control and quick release system also obviates the need for snap shackles, as employed in prior art system illustrated in FIG. 2, which are less reliable, more expensive, and require some re-assembly after release in order to redeploy the kite.

It is a further advantage of the second 10B and third 10C embodiments of my novel kite control and quick release system that all the functions, discussed above, can be incorporated into one molded end fitting 14 or 14' that is easy and inexpensive to manufacture and very easy to install. This represents an economic advantage over the manufacture of prior art control and quick release systems. These embodiments provide more reliable quick release function, easier line winding geometry, better hand protection, bar end protection, and economy of manufacture, compared to the known prior art systems.

Whereas my kite control and quick release system has been described and depicted with respect the sport of kitesurfing, the improved system can also be employed for kite sports and activities conducted on or over land.

As will be apparent to those skilled in the art to which the invention is addressed, the present invention may be embodied in forms other than those specifically disclosed above without departing from the spirt or essential characteristics of the invention. For example, lips 28 and winding surface 30 of end fittings 14 can take on different shapes and orientations; control bar configurations other than the straight bar and handlebar shapes illustrated can be employed; swivel connector 21 can connect between tether 18 and wristband 20, instead of between lead 12 and tether 18, or connect between more than one location; and leads 12 can be dispensed with entirely, with lines 17 connecting directly to tether 18 and stop 24 being mounted somewhere thereon. These and other variations are mere equivalents of the present invention and do not depart from the concept or spirt thereof The particular embodiments of the kite control and quick release system and components thereof described above are therefore to be considered in all respects as illustrations and not restrictive. The scope of the present invention is, as set forth in the appended claims, rather than being limited to the examples of the kite control and quick release system and components thereof set forth in the foregoing description.

The embodiments of the invention to which an exclusive property or privilege is claimed are defined as follows:

1. An improved kite control system compromising:

a control bar;

two elongated end fittings affixed one at each end of said control bar;

each said end fitting having opposed concave winding surfaces comprised of upper and lower lips extending laterally out from the sides of said end fittings in a direction perpendicular to the axis of said control bar and smooth platforms between said upper and lower lips;

kite lines secured to the distal aspect of each end fitting connecting said control bar to a kite;

wherein said concave winding surfaces serve to accommodate the winding, unwinding and stowage of kite lines during break-down, set-up and when said system is not in use.

2. An improved kite control system comprising:

a control bar demonstrating a handlebar configuration;

two elongated end fittings each having at least one concave winding surface, said elongated end fitting being affixed one at each end of said control bar;

kite lines secured to the distal aspect of each end fitting and centrally, on the raised portion of said control bar, connecting said control bar to a kite;

wherein said concave winding surfaces serve to accommodate the winding, unwinding and stowage of kite lines during break-down, set-up and when said system is not in use.

3. An improved kite control and quick release system comprising:

a control bar;

two elongated end fittings each having at least one concave winding surface, said end fittings being affixed one at each end of said control bar;

kite lines secured to the distal aspect of each end fitting connecting said control bar to a kite;

an aperture formed in the distal aspect of at least one of said elongated end fitting;

a stop having a diameter larger than the diameter of said aperture;

at least on release tether with handle;

wherein said kite line is passed through said aperture and secured to the non-handle end of said released tether and said stop is secured to a point on said kite line or tether between said aperture and said tether handle;

wherein said stop serves to secure said kite line to said control bar when said kite is underway;

wherein said kite is quickly de-powered by releasing said control bar while restraining said tethered handle thereby causing the selective restraining of kite lines and release of wind from the kite;

and wherein said concave winding surfaces of said end fittings serve to accommodate the winding, unwinding and stowage of kite lines during break down, set-up and when said system is not in use.

4. The improved kite control and quick release system of claim 3 wherein said release handle is a wristband.

5. An improved kite control and quick release system according to claim 3 further comprising kite leads which function to secure said control bar to said kite lines and wherein said stop is affixed to the kite lead that connects said release tether to said kite line.

6. An improved kite control and quick release system according to claim 3 further comprising a swivel connector which connects said kite line to said release tether.

7. An improved kite control and quick release system according to claim 3 further comprising a second stop secured along said kite line between said aperture and said kite which serves to prevent said control bar from sliding too far kiteward when said bar is released and said kite de-powers.

8. The improved kite control and quick release system of claim 7 wherein the distance between said first stop and said second stop measures at least half the span of said kite.

9. The improved kite control and quick release system of claim 3, wherein said non-tethered kite line is secured to the corresponding end fitting by passing said non-tethered line through an aperture formed in the distal aspect of said corresponding end fitting and securing a stop at the sailor end of said kite line by means of a knot.

10. An improved kite control and quick release system comprising:

a control bar;

kite lines secured to said control bar connecting said control bar to a kite;

a release tether with handle;

a connector with aperture secured to at least one end of said control bar;

a stop having a diameter larger than the diameter of said aperture;

wherein said kite line is passed through said aperture and secured to the non-handle end of said release tether and said stop is secured to a point on said kite line or tether between said aperture and said tether handle;

wherein said stop serves to secure said kite line to said control bar when said kite is underway;

and wherein said kite is quickly de-powered by releasing said control bar while restraining said release handle causing the selective restraining of kite lines and the release of wind from the kite.

11. The improved kite control and quick release system of claim 10 wherein kite leads secure said control bar to said kite lines and said stop is secured along the lead that secures said tether to said kite line.

12. An improved kite control and quick release system according to claim 10 further comprising a swivel connector between said kite line and said tether.

13. An improved kite control and quick release system according to claim 10 further comprising a second stop secured along said kite line between said aperture and said kite which serves to prevent said control bar from sliding too far kiteward when said bar is released and said kite de-powers.

14. The improved control and quick release system of claim 10 wherein the control bar is constructed of hollow tubing and further comprising end caps which serve to seal the ends of said tubing.

* * * * *

UNITED STATES PATENT AND TRADEMARK OFFICE

CERTIFICATE OF CORRECTION

PATENT NO. : 6,273,369 B1
DATED : August 14, 2001
INVENTOR(S) : Thomas G. Nishimura It is certified that error appears in the above-identified patent and that said Letters Patent is hereby corrected as shown below:

Column 11,
Line 10, should read -- at least one release tether with handle; --

Signed and Sealed this

Fifth Day of November, 2002

*Attest:*

*Attesting Officer*

JAMES E. ROGAN
*Director of the United States Patent and Trademark Office*